United States Patent [19]

Narushima

[11] 3,953,344

[45] Apr. 27, 1976

[54] SURFACE TREATMENT COMPOSITION FOR METAL WORKING

[75] Inventor: Uraji Narushima, Yokohama, Japan

[73] Assignee: Nippon Paint Co., Ltd., Osaka, Japan

[22] Filed: July 25, 1974

[21] Appl. No.: 491,943

[30] Foreign Application Priority Data

Aug. 9, 1973 Japan ..... 48-89550

[52] U.S. Cl. ..... 252/32.7 E; 72/42; 252/33; 252/39; 252/49.5

[51] Int. Cl.[2] ..... C10M 1/48; C10M 3/42; C10M 5/04; C10M 7/08

[58] Field of Search ..... 252/32.7 E, 33, 39, 252/49.5; 72/42

[56] References Cited

UNITED STATES PATENTS

| | | | |
|---|---|---|---|
| 3,833,502 | 9/1974 | Leary et al. | 252/49.5 |
| 3,836,467 | 9/1974 | Jones | 252/49.5 |
| 3,893,931 | 7/1975 | Sturwold et al. | 252/49.5 |
| 3,899,625 | 8/1975 | Izumi et al. | 252/49.5 |

*Primary Examiner*—Delbert E. Gantz
*Assistant Examiner*—I. Vaughn
*Attorney, Agent, or Firm*—Wenderoth, Lind & Ponack

[57] ABSTRACT

A surface treatment composition for metal working comprising 10 to 50 parts by weight of a water-soluble thermoplastic synthetic resin having an average degree of polymerization of 300 to 1,700, 40 to 180 parts by weight of an aqueous dispersion of an alkaline earth metal soap and 0.5 to 12 parts by weight of at least one volatile corrosion inhibitor, which can give to a metal panel excellent deep drawing processability, chemical treatment property, rust corrosion resistance or the like.

10 Claims, No Drawings

SURFACE TREATMENT COMPOSITION FOR METAL WORKING

The present invention relates to a surface treatment composition for metal working. More particularly, it relates to a water-dispersible, lubricating surface treatment compsition suitable for treating the surface of metal panel prior to deep drawing processing thereof, by which the deeep drawing processing is easily carried out and further the following washing out of the coating film and the chemical treatment with a phosphate or the like can be easily carried out.

In case of press processing of metal panel, particularly in case of a highly advanced processing such as deep drawing processing an oil is usually applied to the surface of the metal panel immediately before the press processing. When such oil is applied to the metal panel, it is essential to remove the corrosion inhibitor which is previously applied to the metal panel. Thus, in the conventional press processing, it requires two steps of the removement of the corrosion inhibitor and the application of press processing oil. Moreover, even if such press processing oil is applied, it does not necessarily give satisfactory press processing property.

Recently, it has been proposed that, instead of using of the press processing oil, the metal panel is previously cleaned and then to the surface thereof is applied a wax of a synthetic resin to form a dry film thereon, by which the panel becomes to be easily handled since it is not sticky in comparison with the press processing oil and the highly advanced press processing such as deep drawing processing can be carried out. However, there has not yet been found a practically useful method.

Under the circumstances, the present inventors have studied intensively to find a surface treating agent useful for such purpose.

Generally, when a surface treating agent is applied to the metal panel in a form of aqueous solution or aqueous dispersion, it is very important that the surface treating agent is homogeneously and stably kept in the aqueous medium. Otherwise the metal plate can not be uniformly coated and as the result, the lubricating property of the panel is disadvantageously affected in the deep drawing processing procedure. Accordingly, it is desirable that the surface treating agent can be homogeneously dispersed in water and can be applied to the metal panel without heating and can give unsticky coating film.

Besides, it is very difficult to obtain a coated metal panel having an enough corrosion resistance, which coating can be easily washed out after the deep drawing processing and further to which the conventional chemical treatment with phosphate or the like can be easily applied. That is, when a conventional corrosion inhibitor is applied to the metal panel, it is firmly adsorbed onto the metal surface, and therefore such coating of the corrosion inhibitor is hardly removed by a conventional alkali cleaner and it must be washed by a specific method such as acid pickling. On the other hand, when the metal panel is coated with a corrosion inhibitor which can be easily washed out, the panel is rusted before the press processing such as deep drawing processing, and further the product obtained by the press processing is rusted before the surface treatment such as painting. Moreover, if the corrosion inhibitor can not be completely washed out, the remaining corrosion inhibitor gives undesirable effect to the following chemical treatment with phosphate or the like. That is, if the corrosion inhibitor remains even slightly, the treatment with phosphate or the like can not be uniformly and densely applied, which causes the poor adhesion and corrosion resistance of the following coating such as painting.

The present inventors have studied to find a method for obtaining a coated metal panel having no such defects, and it has now been found that such defects can be easily dissolved by applying a specific surface treating agent to the metal panel.

An object of the present invention is to provide a surface treatment composition for metal working, which can give to the substrate, metal panel a lubricating property suitable for deep drawing processing and an enough corrosion inhibiting property and further which can be easily washed out with a mild alkali cleaner, and further by which the following chemical treatment of the metal panel can be easily carried out.

Another object of the invention is to provide a water-dispersible surface treatment composition for metal working, which can be homogeneously and stably kept in water and can be applied to the substrate metal panel without heating to give an unsticky coating film.

These and other objects of the invention will be appear from the description hereinafter.

The surface treatment composition of the present invention comprises 10 to 50 parts by weight of a water-soluble thermoplastic synthetic resin having an average degree of polymerization of 300 to 1,700, 40 to 180 parts by weight of an aqueous dispersion of an alkaline earth metal soap and 0.5 to 12 parts by weight of a volatile corrosion inhibitor.

The water-soluble thermoplastic synthetic resin used in the present invention includes all the conventional resin, for instance, may be polyvinyl alcohol or its modified product or polyacrylate. These resins have the average degree of polymerization of 300 to 1.700, in the range of which the resins are water-soluble. When it has an average degree of polymerization of less than 300, the deep drawing processability of the coated metal panel decreases. On the other hand, when it is over 1,700, the formed coating film can hardly be washed out. The preferred range of the average degree of polymerization is 500 to 1,000 in which range the deep drawing processability is extremely increased without difficulty of washing out. The resiin is used in a range of 10 to 50 parts, preferably 20 to 40 parts by weight. When it is less than 10 parts by weight, the deep drawing processability of the coated metal panel decreases, and on the other hand, when it is more than 50 parts by weight, the formed coating film is hardly washed out.

The polyvinyl alcohol has preferably a saponification degree of 75 % or more from the viewpoint of that it must be water-soluble. When it has a saponification degree of less than 75 %, the formed coating film tends to have less mechanical strength and difficulty of washing out. As the modified product of the polyvinyl alcohol there may be an ammonium salt of a phosphatic esterified polyvinyl alcohol or a carboxy-polyvinyl alcohol. The ammonium salt of a phosphatic esterified polyvinyl alcohol has preferably 25 to 75 % of the esterification degree of the hydroxy group in the polyvinyl alcohol. When an ammonium salt of a phosphatic esterified polyvinyl alcohol having a esterification degree of 45 to 55 % is used, the adhesion of the coating film to the metal panel is increased in comparison with that by using other modified polyvinyl alcohol having other range of esterification degree within 25 to 75 %, and the deep drawing processability is increased. Moreover, the formed coating film is easily washed out.

The carboxy-polyvinyl alcohol has preferably 1 to 20 % of the carboxylation degree of the hydroxy group in the polyvinyl alcohol. When a carboxy-polyvinyl alcohol having a carboxylation degree of 5 to 10 % is used, the adhesion of the coating film to the metal panel is increased in comparison with that by using other modified polyvinyl alcohol having other range of carboxylation degree within 1 to 20 %, and the deep drawing processability is increased. Moreover, the formed coating film is easily washed out.

As the polyacrylate, there may be used sodium polyacrylate, ammonium polyacrylate, calcium polyacrylate, or the like.

The preferred examples of the alkaline earth metal soap may be an alkaline earth metal salt (e.g. calcium salt) of higher fatty acid having 8 to 22 carbon atoms (e.g. palmitic acid, stearic acid, oleic acid, capric acid, lauric acid, myristic acid, arachidic acid or behenic acid). The aqueous dispersion of the alkaline earth metal soap may be prepared by a conventional method. For instance, the soap is dispersed in water by using an anionic and/or nonionic surface active agent having benzene ring in the molecule. The anionic surface active agent includes alkylnaphthalenesulfonate, dodecylbenzenesulfonate, alkylsulfate, or the like. The nonionic surface active agent includes polyethyleneglycol ethers such as polyethyleneglycol oleyl ether, polyethyleneglycol nonylphenyl ether, polyethyleneglycol lauryl ether, or the like. Among these surface active agents, dodecylbenzenesulfonate as the anionic surface active agent and polyethyleneglycol nonylphenyl ether as the nonionic surface active agent are preferable one since they can give good dispersibility to the alkaline earth metal soap, and further both surface active agents are used together, the dispersibility of the soap becomes better and thereby there is obtained good water-dispersible and homogeneous surface treating agent.

The aqueous dispersion of alkaline earth metal soap may be used in a concentration of the alkaline earth metal soap of 40 to 60 % by weight, and in an amount of 40 to 180 parts, preferably 80 to 160 parts by weight. When the aqueous dispersion is used in an amount of less than 40 parts by weight, the deep drawing processability of the coated metal panel is decreased, and on the other hand, when the amount is over 180 parts by weight, the formed coating film is hardly washed out. Furthermore, when the alkaline earth metal soap is used as it is, it requires to heat for coating with the surface treating agent and the formed coating film is moistened and becomes sticky. On the contrary, the aqueous dispersion of the alkaline earth metal soap is used as in the present invention. The surface treating agent can be uniformly applied to the metal panel without heating and further the formed coating film is not sticky.

Thus, the combining the water-soluble thermoplastic resin and the aqueous dispersion of alkaline earth metal soap can give excellent surface treating agent, which gives to the metal panel excellent properties, such as superior deep drawing processability, easier washing out property and excellent chemical treatment property. But, according to the present invention, more excellent surface treating agent can be obtained by adding thereto a volatile corrosion inhibitor. That is, by using a surface treatment composition comprising the three components: the water-soluble thermoplastic resin, the aqueous dispersion of alkaline earth metal soap and the volatile corrosion inhibitor, the coated metal panel shows excellent corrosion resistance without decrease of the deep drawing processability, the washing out property and the chemical treatment property.

The volatile corrosion inhibitor is generally volatile and disappears with the lapse of time, which phenomenon is promoted at a higher temperature. Accordingly, such volatile corrosion inhibitor has short holding time and its corrosion resistance can not be held unless it is kept in a sealed vessel. From these viewpoints; the volatile corrosion inhibitor has never considered to incorporate into the surface treating agent. According to the present invention, however, it has been found that the volatile corrosion inhibitor can be stably incorporated into the surface treating agent and the corrosion resistance of the metal panel coated with such surface treating agent can be held even if the surface treating agent is dried by heating and the metal panel coated with the surface treating agent is allowed to stand at the atmosphere.

The volatile corrosion inhibitor used in the present invention includes all of the conventional one, for instance, benzoate, isopropylbenzoate, azelate, phenolate, salicylate, ethylhexanoate, butylphosphonate, ethylsulfonate, nitrite, carbonate, borate or carbamate of an organic ammonium (e.g. n- or isoamyl ammonium, mono- or diisopropyl ammonium, dibutyl ammonium, mono- or di-cyclohexyl ammonium, phenolhydrazino ammonium, mono-, di- or triethanol ammonium, ethylmorpholino ammonium, or naphthyl ammonium), a mixture of two or more kinds thereof, or a mixture thereof with an amine salt of aliphatic acid. The preferred examples of the volatile corrosion inhibitor may be dicylcohexyl ammonium nitrate, dicyclohexyl ammonium carbonate, dicyclohexyl ammonium benzoate, diisopropyl ammonium benzoate, diisopropyl ammonium nitrite, diethanol ammonium benzoate, or the like. The volatile corrosion inhibitor may be preferably used in an amount of 0.5 to 12 parts, preferably 2 to 8 parts by weight. When it is used in an amount of less than 0.5 part by weight, the coated metal panel is easily rusted before or after the deep drawing processing, and on the other hand, when it is used in more than 12 parts by weight, the formed coating film is hardly washed out and further the chemcial treatment of the metal panel is hardly carried out.

When the present surface treatment composition comprising the three components above-mentioned is used, 50 parts by weight of the composition is mixed with 150 to 300 parts by weight of water, and the mixture is applied to the surface of the metal panel to be treated so as to be 2 to 3 g/m$^2$ in dry state and then dried. The surface treatment composition can be applied to the metal panel by a conventional coating method, such as roll coating, brushing, dipping spray coating or flow coating without heating. The present surface treatment composition is not a baking or thermosetting type agent, and therefore, it is not necessary to heat at a high temperature or a long time, but various methods such as natrual drying or mild heat drying may be optionally applied. Accordingly, the age-hardening of the metal can be avoided.

The metal panel treated with the present surface treatment composition has excellent deep drawing processability, chemical treatment property and corrosion resistance, and the formed coating film is easily washed out and further is not sticky and therefore it is easily handled.

The surface treatment composition of the present invention may be optionally incorported with other components, such as pigments, dyestuffs, defoaming agents, antiseptic agents, perfumes, or the like which do not give any undesirable effect to the composition.

The present invention is illustrated by the following Examples but not limited thereto.

EXAMPLES 1 TO 11

To water (500 parts by weight) are mixed at room temperature a water-soluble thermoplastic synthetic resin, an alkaline earth metal soap and a volatile corrosion inhibitor in the ratio as mentioned in the following Table I to give a surface treatment composition. After allowing to stand for 6 months, the surface treatment composition is still kept in good homogeneous and stable state.

The surface treatment composition is applied to a cold-rolled steel panel (SPC-1; 70 × 150 × 0.8 mm) which is previously washed with a mild alkali degreasing agent by using a bar coater so as to be 2 to 3 g/m² in dry state, and then dried at 120°C for 2 minutes. The coated steel panel is subjected to cup drawing test, corrosion resistance test, test for washing out of coating film, phosphate treatment test, and indoor standing test. The results are shown in Table II.

The tests as listed above are carried out in the following manner.

1. Cup drawing test

By using Sheet Metal Tester Model 142-12 (made by Erichsen), the test panel is tested under the conditions of punch diameter: 33 mm, punch shoulder radius: 4.5 mm, die diameter: 70 mm, die shoulder radius: 3 mm and hold-down force: 3,000 kg.

Evaluation:

O: The drawing processing is normally effected and the deep drawing pressure is lower. The deep drawing pressure is 2.6 tons or less. O : The drawing processing is normally effected. The deep drawing pressure is 2.7 tons or more.

Δ : The drawing processing is effected, but a few bucklings are observed on the metal surface. The deep drawing pressure is 2.7 tons or more.

X : Many bucklings are observed on the metal surface or it is broken and can not be formed. The deep drawing pressure is 2.7 tons or more.

2. Corrosion resistance test

The test panel is put in a sealed vessel and tested at a temperature of 25 ± 1°C and at a humidity of 95 % or more for 30 days.

Evaluation:

O : No rust occurs.

Δ : Rust of 5 % or less occurs.

X : Rust of 6 % or more occurs.

3. Test for washing out of coating film

The test panel is treated with a mild alkali degreasing agent (Lidorine No. 75 TX-51, trade name of Nippon Paint Co., Ltd.) under the conditions of a concentration: 2 %, temperature: 65° to 70°C, spraying pressure: 1 kg/cm² and time: 2 minutes, and then the test panel is tested by washing with water for 0.5 minutes.

Evaluation:

O : Water repellency is 0 %.

Δ : Water repellency is 10 % or less.

X : Water Phosphate is 11 % or more.

4. Phospphate treating test

Zinc phosphate treating agent (Granodine No. 16N-5, trade name of Nippon Paint Co., Ltd.) is applied to the test panel under the condition of the concentration (point: 15, acid ratio: 10 and toner: 1.0), temperature: 55°C, spraying pressure: 1 kg/cm² and time: 2 minutes, and then the test panel is tested by washing with water for 0.5 minute and then by drying.

Evaluation:

O : The appearance of the phosphate coating is uniform by visual investigation, and by microscope investigation the crystals of zinc phosphate are fine.

Δ : The appearance of the phosphate coating is uniform by visual investigation, but by microscope investigation the crystals of zinc phosphate are coarse.

X : The appearance of the phosphate coating is not uniform by visual investigation and many interstices are observed in the film.

Table I

| Example number | Water-soluble thermoplastic synthetic resin: Sodium polyacrylate, Average degree of polymerization | | | Polyvinyl*1 alcohol, Average degree of polymerization | | | Modified*2 product of polyvinyl alcohol, Esterification degree (%) | | Modified*3 product of polyvinyl alcohol, Carboxylation degree (%) | | Aqueous*4 dispersion of alkaline earth metal soap | Volatile*5 corrosion inhibitor |
|---|---|---|---|---|---|---|---|---|---|---|---|---|
| | 300 | 500 | 1500 | 300 | 500 | 1500 | 25 | 50 | 3 | 7 | | |
| 1 | 35 | | | | | | | | | | 140 | 5 |
| 2 | | 33 | | | | | | | | | 132 | 5 |
| 3 | | | 33 | | | | | | | | 132 | 5 |
| 4 | | | | 33 | | | | | | | 132 | 5 |
| 5 | | | | | 33 | | | | | | 132 | 5 |
| 6 | | | | | | 33 | | | | | 132 | 5 |
| 7 | | | | | | | 33 | | | | 132 | 5 |
| 8 | | | | | | | | 33 | | | 132 | 5 |
| 9 | | | | | | | | | 33 | | 132 | 5 |
| 10 | | | | | | | | | | 33 | 132 | 5 |

Table I-continued

| Example number | Water-soluble thermoplastic synthetic resin | | | | | | | | | | Aqueous*4 dispersion of alkaline earth metal soap | Volatile*5 corrosion inhibitor |
|---|---|---|---|---|---|---|---|---|---|---|---|---|
| | Sodium polyacrylate | | | Polyvinyl*1 alcohol | | | Modified*2 product of polyvinyl alcohol | | Modified*3 product of polyvinyl alcohol | | | |
| | Average degree of polymerization | | | Average degree of polymerization | | | Esterification degree (%) | | Carboxylation degree (%) | | | |
| | 300 | 500 | 1500 | 300 | 500 | 1500 | 25 | 50 | 3 | 7 | | |
| 11 | | | | | | | | | | 33 | 132 | 5*6 |

[Note]:
*1Saponification degree is 80 %.
*2Ammonium salt of phosphatic esterified polyvinyl alcohol having an average degree of polymerization: 500 and a saponification degree: 80 %
*3Carboxy modified product of polyvinyl alcohol having an average degree of polymerization: 500 and a saponification degree: 80 %
*4A mixture of calcium stearate (50 parts by weight), sodium dodecylbenzenesulfonate (5 parts by weight), polyethyleneglycol nonylphenyl ether (5 parts by weight) and water (40 parts by weight)
*5Corotex VPI (trade name of Dai-ichi Croda Chemicals Co., Ltd.)
*6Dicyclohexyl ammonium nitrite (Crystal No. 260, trade name of Daiwa Kasei Co.)

Table II

| Example number | Test results | | | | |
|---|---|---|---|---|---|
| | Cup drawing | Corrosion resistance | Washing out of coating film | Phosphate treatment | Indoor standing |
| 1 | Δ | O | O | O | |
| 2 | O | O | O | O | |
| 3 | O | O | Δ | O | |
| 4 | Δ | O | O | O | |
| 5 | O | O | O | O | No rust is observed for 3 months |
| 6 | O | O | Δ | O | |
| 7 | O | O | O | O | |
| 8 | ◎ | O | O | O | |
| 9 | O | O | O | O | |
| 10 | ◎ | O | O | O | |
| 11 | ◎ | O | O | O | |

COMPARATIVE EXAMPLES 1 To 8

To water (500 parts by weight) are mixed at room temperature a polyvinyl alcohol having an average degree of polymerization: 500 and a saponification degree: 80 % (as the water-soluble thermoplastic synthetic resin), an aqueous dispersion of an alkaline earth metal soap (same as used in the above Examples), a volatile corrosion inhibitor (same as used in the above Examples), and a water-soluble corrosion inhibitor in the ratio as mentioned in the following Table III to give a surface treatment composition.

The surface treatment composition thus obtained is applied to a cold-rolled steel panel in the same manner as described in the above Examples, and then the panel is tested as well. The results are shown in Table IV.

COMPARATIVE EXAMPLES 9 To 10

Press oil (Nippon Kosaku Oil 660, trade name of Nippon Kosaku Oil Co.) (Comparative Example 9) and wax type treating agent (Lubecoat, trade name of Bethlehem Co.) (Comparative Example 10) are used as the surface treating agent. These are applied to cold-rolled steel panel in the same manner as in the above Examples and the panel is tested as well. The results are also shown in Table IV.

Table III

| Comparative Example number | Water-soluble thermoplastic synthetic resin | Aqueous dispersion of alkaline earth metal soap | Volatile corrosion inhibitor | Water-*7 soluble corrosion inhibitor | Water-*8 soluble corrosion inhibitor |
|---|---|---|---|---|---|
| 1 | 33 | 132 | 0.3 | | |
| 2 | 33 | 132 | 14.0 | | |
| 3 | 33 | 132 | | 0.3 | |
| 4 | 33 | 132 | | 5.0 | |
| 5 | 33 | 132 | | 14.0 | |
| 6 | 33 | 132 | | | 0.3 |
| 7 | 33 | 132 | | | 5.0 |
| 8 | 33 | 132 | | | 14.0 |

[Note]:
*7Sanhibitor No. 3 (trade name of Sanyo Kasei Co.)
*8Coromine WZ (trade name of Kao Sekken K.K.)

Table IV

| Comparative Example number | Test results | | | | |
|---|---|---|---|---|---|
| | Cup drawing | Corrosion resistance | Washing out of coating film | Phosphate treatment | Indoor standing |
| 1 | O | X | O | O | After 3 weeks, rust spot is observed |
| 2 | O | O | Δ | Δ | No rust is observed for 3 months |
| 3 | O | X | Δ | Δ | After 1 week, rust spot is observed |

Table IV-continued

| Comparative Example number | Test results | | | | |
|---|---|---|---|---|---|
| | Cup drawing | Corrosion resistance | Washing out of coating film | Phosphate treatment | Indoor standing |
| 4 | O | Δ | Δ | X | After 1 week, rust spot is observed |
| 5 | O | O | X | X | After 3 weeks, rust spot is observed |
| 6 | O | Δ | Δ | Δ | After 1 week, rust spot is observed |
| 7 | O | Δ | Δ | Δ | After 2 weeks, rust spot is observed |
| 8 | O | Δ | Δ | X | After 3 weeks, rust spot is observed |
| 9 | X | Δ | Δ | Δ | After 1 week, rust spot is observed |
| 10 | ◎ | Δ | X | X | No rust is observed for 2 months |

As made clear from the above test results, the surface treatment composition of the present invention showes excellent effect in the cup drawing, corrosion resistance, washing out of coating film, chemical treatment and further indoor standing tests. Even if the surface treatment composition comprises the same components, if the amount of the component (i.e. the volatile corrosion inhibitor) is out of the range as in the present invention, the satisfactory corrosion resistance property, washing out of coating film and chemical treatment can not be achieved. Besides, when a water-soluble corrosion inhibitor is used instead of the volatile corrosion inhibitor, the properties other than cup drawing processability are not satisfactory. Moreover, when the conventional press oil or wax type treating agent is used, whole properties are inferior.

What is claimed is:

1. A surface treatment composition for metal working, which comprises 10 to 50 parts by weight of a water-soluble thermoplastic synthetic resin having an average degree of polymerization of 300 to 1,700, 40 to 180 parts by weight of an aqueous dispersion of an alkaline earth metal soap and 0.5 to 12 parts by weight of at least one volatile corrosion inhibitor.

2. The surface treatment composition according to claim 1, wherein the water-soluble thermoplastic synthetic resin has an average degree of polymerization of 500 to 1,000.

3. The surface treatment composition according to claim 1, wherein the water-soluble thermoplastic synthetic resin is a member selected from the group consisting of a polyvinyl alcohol having a saponification degree of 75 % or more, an ammonium salt of a phosphatic esterified polyvinyl alcohol having an esterification degree of 25 to 75 %, a carboxy-polyvinyl alcohol having a carboxylation degree of the hydroxy group in the polyvinyl alcohol of 1 to 20 %, sodium polyacrylate, ammonium polyacrylate and calcium polyacrylate.

4. The surface treatment composition according to claim 1, wherein the alkaline earth metal soap is an alkaline earth metal salt of a higher fatty acid having 8 to 22 carbon atoms.

5. The surface treatment composition according to claim 1, wherein the aqueous dispersion of an alkaline earth metal soap is the one which is prepared by dispersing the soap in water by using at least one surface active agent selected from the group consisting of an anionic surface active agent and a nonionic surface active agent.

6. The surface treatment composition according to claim 5, wherein the surface active agent is a combination of dodecylbenzenesulfonate and polyethyleneglycol nonylphenyl ether.

7. The surface treatment composition according to claim 1, wherein the aqueous dispersion of an alkaline earth metal soap is used in a concentration of the alkaline earth metal soap of 40 to 60 % by weight.

8. The surface treatment composition according to claim 1, wherein the volatile corrosion inhibitor is a member selected from the group consisting of an organic ammonium benzoate, an organic ammonium isopropyl benzoate, an organic ammonium azelate, an organic ammonium phenolate, an organic ammonium salicylate, an organic ammonium ethylhexanoate, and organic ammonium butylphosphonate, an organic ammonium ethylsulfonate, an organic ammonium nitrite, an organic ammonium carbonate, an organic ammonium borate and an organic ammonium carbamate, in which the organic ammonium is a member selected from the group consisting of n- or isoamyl ammonium, mono- or diisopropyl ammonium, dibutyl ammonium, mono- or dicylclohexyl ammonium, phenolhydrazino ammonium, mono-, di- or triethanol ammonium, ethylmorpholino ammonium and naphthyl ammonium.

9. The surface treatment composition according to claim 1, wherein the volatile corrosion inhibitor is a member selected from the group consisting of dicyclohexyl ammonium nitrite, dicyclohexyl ammonium carbonate, dicyclohexyl ammonium benzoate, diisopropyl ammonium benzoate, diisopropyl ammonium nitrite and diethanol ammonium benzoate.

10. The surface treatment composition according to claim 1, wherein the water-soluble thermoplastic synthetic resin is a carboxy-polyvinyl alcohol having a carboxylation degree of the hydroxy group in the polyvinyl alcohol of 1 to 20%, the aqueous dispersion of the alkaline earth metal soap is prepared by dispersing the soap in water by using a mixture of anionic and nonionic surface active agents and the volatile corrosion inhibitor is dicyclohexyl ammonium nitrite.

* * * * *